United States Patent [19]

Cawley

[11] 3,949,471

[45] Apr. 13, 1976

[54] PROCESS AND MEANS FOR GEL CUTTING

[76] Inventor: Leo P. Cawley, P.O. Box 8152, Wichita, Kans. 67208

[22] Filed: May 28, 1974

[21] Appl. No.: 473,585

Related U.S. Application Data

[63] Continuation-in-part of Ser. No. 294,696, Oct. 3, 1972, abandoned.

[52] U.S. Cl. ..... 30/123.3; 83/5; 83/100

[51] Int. Cl.[2] ..... B26B 27/00

[58] Field of Search ..... 83/24, 22, 5, 100; 30/123.3, 133

[56] References Cited

UNITED STATES PATENTS 2,463,455 3/1949 Dann ..... 83/100 X

*Primary Examiner*—J. M. Meister

*Attorney, Agent, or Firm*—John H. Widdowson

[57] ABSTRACT

A process and a gel cutting device constructed and adapted to remove gel like material from a surface, the device having a hollow body with fluid communication therethrough, a pickup conduit attached to the inlet of the body, a cutter on the inlet end of the pickup conduit. The outlet of the body is connectable to a vacuum source. In operation the process and the gel cutter have the cutter of the pickup conduit passed into gel material, cutting same and passing the removed material through the pickup conduit into the hollow body.

4 Claims, 6 Drawing Figures

PROCESS AND MEANS FOR GEL CUTTING

This is a continuation in-part application of my copending application, Ser. No. 294,696, filed Oct. 3, 1972, now abandoned.

BACKGROUND OF THE INVENTION

1. Field of the Invention

This invention relates to a process and apparatus for cutting gel. More specifically, this invention provides a process and apparatus for cutting gel from a layer of gel material on a slide and remove it therefrom by using vacuum pressure.

2. Description of the Prior Art

Numerous types of vacuum nozzles are known in the prior art which are adapted for use with a vacuum source as a means to pick up in a scraping manner surface coverings such as paint, varnish and so forth. Other prior art devices are known for use in picking up materials which use ejector type nozzles at a high pressure source to move particles into the device and through a conduit and discharge. Some prior art devices are known in the art as operable to punch apertures into a layer of gel material on a slide and remove the cut slugs of gel material so that perforated layer on the slide can be used in laboratory analysis. The device known in the prior art to punch apertures in a layer of gel material is constructed so as to punch a plurality of apertures in the gel material in a circular pattern with the individual apertures being circular. Such a device is disclosed in U.S. Pat. No. 2,463,455 by M. Dann, issued Mar. 1, 1949. Dann teaches a crude punch for semi-solid media which is very inefficient. The cutter portion in Dann is circular vice flattened which means that it is not readily adaptable for cutting in a linear path. Also, Dann shows no hollow body of sufficient size having handles thereon to facilitate a user's grasp for linear cutting. The cutting edge in Dann has an areal opening larger than the hollow body (indicated as 1 therein); therefore, a large portion of the vacuum pressure is lost in the cutter.

Various other tools have been designed and devised for working in medical and scientific research for the particular purpose of working with agar gel and placing it on slides and molding, forming or otherwise working with it after it has been poured and after it has set. The general purpose of some of these working tools is to form cuts, cavities or wells in the agar gel layer after it is formed on a slide. With the exception of a molded pre-shaped agar gel slide, the hand tools known to the prior art are designed to scrap or more or less dig a cavity or well in the gel material after it has been placed on the slide. These hand tools require much careful manipulation in order to remove the gel material from the slide in a particular and desired shape without causing the gel material to fall onto the adjacent gel material of the remainder of the slide covering adjacent to the formed cavity or well. No hand tool is known in the prior art which provides a means of cutting a layer of agar gel material on a slide and removing it from the area so as to prevent its contact with the remaining portions of the layer or covering.

SUMMARY OF THE INVENTION

In one preferred specific embodiment, a cutting hand tool structure includes a hollow body with a pickup conduit extending therefrom having a cutter on the outer end portion thereof and the hollow body being connectable to a vacuum source so as to be usable to the removal of gel like material in the path of the pickup conduit. The gel cutter structure is adapted to in operation be used for the forming of a well or recess in or passageway through a layer of agar gel material on a slide. The cutter portion of the inlet end of the conduit is moved through the layer of gel with the gel being moved by the vacuum pressure through the pickup conduit into the hollow portion of the body. The cutter portion of the pickup conduit has a bladelike edge on its outer portion adapted to cut the gel material and simultaneously pass the cut out gel material to the interior of the conduit. The body is separable into two portions, one portion remaining with the inlet conduit and the other portion connectable with a flexible conduit joining same to a vacuum pressure source.

One object of this invention is to provide a process for cutting gel and a gel cutter structure overcoming the aforementioned disadvantages of the prior art devices.

Still, one other object of this invention is to provide a process for cutting gel and a gel cutting structure having means to cut gel material from a layer of gel material on a slide and remove it therefrom by using vacuum pressure.

Still, another object of this invention is to provide a process for cutting gel and a gel cutting structure having a hollow body with a pickup conduit extending therefrom having on one end portion a cutter portion which is constructed and adapted to cut gel material from a layer of same and pass the cut out gel into the pickup conduit and on into the hollow body moving it by vacuum pressure.

Yet, another object of this invention is to provide a process for cutting gel and a gel cutting device which is usable with a water vacuum device and connected thereto by a flexible conduit to provide a means of cutting and removing gel material from an agar gel coated slide.

Yet, an additional object of this invention is to provide a gel cutting process and device which has a hollow body that is separable into two portions; one portion being connectable with a flexible vacuum source conduit and the other portion having a pickup conduit extending therefrom, the pickup conduit having an annular cutting edge on its outer portion.

Various other objects, advantages, and features of the invention will become apparent to those skilled in the art from the following discussion, taken in conjunction with the accompanying drawing in which:

DETAILED DESCRIPTION OF THE INVENTION

Figure 1:
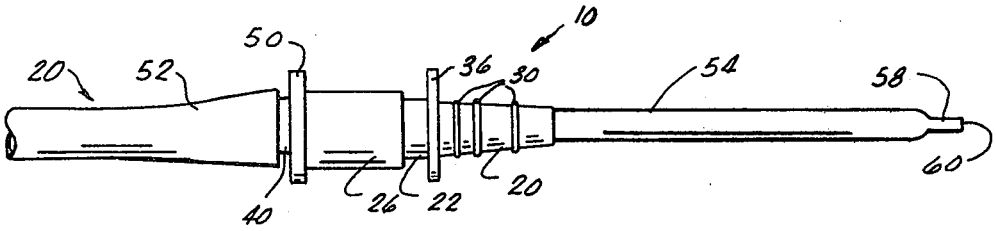
FIG. 1 is an elevation view of the gel cutting device attached to a vacuum conduit segment showing the narrow side of the cutter portion.

The following is a discussion and description of preferred specific embodiments of the gel cutting process and gel cutting means structure of this invention, such being made with reference to the drawings, whereupon the same reference numerals are used to indicate the same or similar parts and/or structure. It is to be understood that such discussion and description is not to unduly limit the scope of the invenion.

Figure 2:
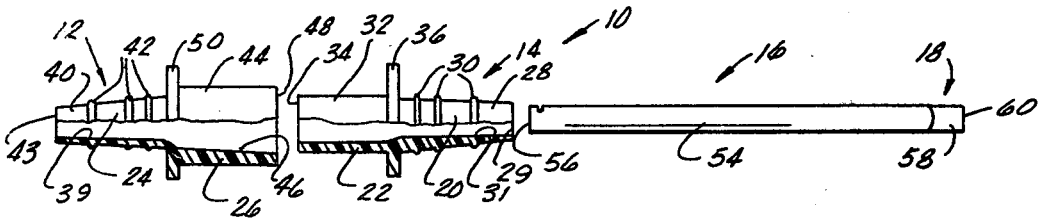
FIG. 2 is a partially cutaway and exploded elevation view of the gel cutting device with the body portion separated into its two pieces and the pickup conduit separated from its body portion and showing the broad side of conduit cutter portion.

Referring to the drawing in detail and in particular to FIGS. 1 and 2, the gel cutting device is shown therein and generally indicated at 10 in FIG. 1 in the assembled condition and in FIG. 2 in a disassembled and exploded condition. The gel cutter structure includes a separable body with portions thereof generally indicated at 12 and 14. a pickup conduit 16 with the cutter portion 18 on its outer end portion. When assembled for operation the gel cutting device 10 is connected to a flexible conduit 20 and held in a persons hand. The body portions 12 and 14 are hollow on the interior and provide fluid communications from the pickup conduit 16 to the flexible conduit 20. The cutter portion 18 is a shaped portion of the pickup conduit 16 shown having an elongated oval shape.

Figure 4:
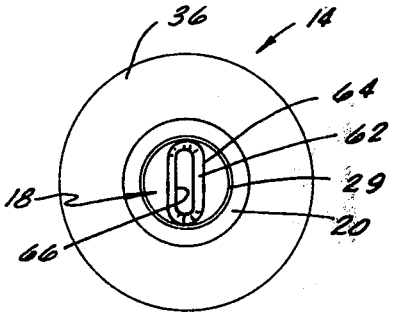
FIG. 4 is an end elevation view of the gel cutting device taken from the inlet end thereof.

FIG. 2 shows in detail the structure of the gel cutting device 10 with the parts thereof in an exploded relation. The body of the device consists of two separable body portions 14 and 16 which join in an overlapping relation. One body portion 14 is the inlet body portion, such is connected with the pickup conduit 16 on its inlet end portion 20. The inlet body portion 14 has an inlet end portion 20 which is connected with the pickup conduit 16 and outlet and joining portion 22 which is connectable with the other body portion 12. The body portion 12 is the outlet body portion and has an outlet end 24 which is in operation connected on one end with the flexible conduit 20 and on its opposite end has an inlet joining end portion 26 connectable with the inlet body portion 14. In detail the inlet body portion 14 has the inlet portion 20 thereof generally conically shaped and extending in an opposite direction from the outlet end joining portion. The outer surface 28 of the inlet portion 20 is generally conically shaped on the exterior and has a generally cylindrical passageway 31 through the center portion thereof. The outer surface 28 is provided with a pluality of ridges 30 extending therefrom and therearound preferably positioned as shown. The interior cylindrical passageway 31 in the inlet portion 20 is sized so as to have the pickup conduit 16 held in it by an interference fit. The outlet and joining portion of the inlet body portion 14 is preferably constructed with a cylindrical inside wall having a tapered cross-section. The exterior surface of the outlet and joining portion 22 is indicated at 32 and has a frustro-conical shape with a larger portion being adjacent to the inlet portion 20 and smaller portion forming the end 34. The taper of the side wall 32 is slight and such is provided to permit it a substantial contact with the inlet and joining portion 26 of the outlet body portion 12 as will be described. In the center portion of the inlet body portion 14 a radially extending handle 36 is positioned therearound. FIG. 4 shows in a detail inlet end view the relation of the handle 36 on the inlet body portion 14. The handle 36 is a ring-like structure extending outward from the junction of the inlet and joining portion 22 and the inlet portion 20. In use the handle 36 (or the ridges 30) is grasped to hold and manipulate the device 10.

Figure 3:
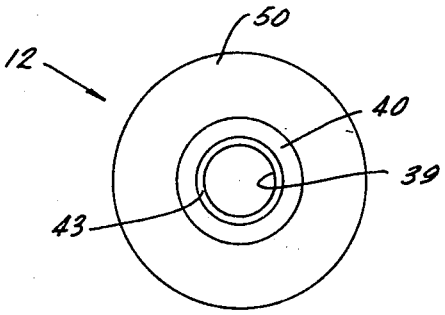
FIG. 3 is an end elevation view of the gel cutting device taken from the outlet end thereof.

The outlet body portion 12 is constructed generally similar to the inlet body portion 14 with the exception that the joining end portion 26 thereof is constructed to slip over the joining end portion 22 of the inlet body portion 14. The outlet end portion 24 has a generally conically shaped outer surface 40 extending oppositely from the inlet end joining portion of 26 with a plurality of ridges 42 extending therearound. The interior of the outlet portion 24 has a cylindrically shaped interior passageway 39 connecting with the outlet portion end 43. The inlet and joining portion 26 is a generally cylindrical shape having an outer side wall 44 and inner side wall 46. The inner side wall 46 is slightly tapered so as to match with the exterior side wall 32 of the inlet body portion 14 when the two body portions are joined. The inlet and joining portion side wall 26 terminates at the outlet body portion end 48. The handle 50 is a ring-like portion extending from the juncture of the outlet end portion 24 and the inlet end portion 26. The FIG. 3 shows in an end view detail the relation of the handle 50 of the outlet body portion 12. The outer surface 40 and of the outlet portion 24 in operation receives the interior of a flexible conduit 20.

The assembled cutting device is shown in FIG. 1 with a flexible conduit 20 attached to the outer body portion 12 engaged on the outlet portions exterior surface 24. The conduit 20 stretches into a bell-shaped appearance indicated in 52 when stretched over the frusto-conical shaped outer portion 24. The ridges 42 serve to retain the flexible conduit 20 on the outer portion 24 in a sealed condition. Preferably the flexible conduit 20 is resilient so its inherent contracting force will hold it in place. The passageway through the outer portion 24 provides fluid communication between the flexible conduit 20 and the interior of the inlet and joining portion 26. When the outlet body portion 12 and the inlet body 14 are joined as shown in FIG. 1 it is essentially a hollow body with a cavity or hollow space formed between the interior portions of the connected body portions 12 and 14.

Figure 5:
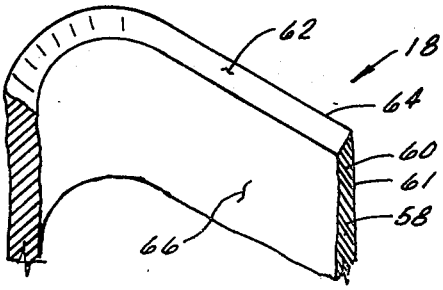
FIG. 5 is an enlarged perspective view of a portion of the gel cutting devices cutter blade taken from the interior thereof.

The pickup conduit 16 is an elongated cylindical conduit having the cutter portion 18 on one end thereof. The pickup conduit 16 has a shank portion 54 which is elongated and forms the major portion thereof. Shanks portion 54 is generally longer than body portions 12 and 14. At one end of the shank portion 54 is the outlet end 56 of the pickup conduit 16 and it is insertable into the cylindrical passageway of the inlet body portion 14 through its end at 29. The internal diameter of pickup conduit 16 is smaller than the internal diameter of body portions 12 and 14 to provide greater suction force in the pickup conduit 16. The opposite end of the pickup conduit shank 54 has the cutter portion 18 with consists of the shaped end portion 58 and a cutting edge 60 on the extreme end thereof. The shaped end portion 58 is a flattened portion of the conduit and is shown in the drawing as having an elongated oval or elliptical cross-sectional shape. The cutting edge 60 is shown in detail in FIG. 5 wherein a segment of one side of the end portion 58 is shown in cut away form. The cutting edge 60 has a cutting surface 62 joining the exterior conduit surface 61 and the interior conduit surface 66. The cutting surface 62 is preferably oriented as shown connecting the cutting edge end 64 on the exterior of the conduit with the interior wall in an anngular relation. The structure of the cutting edge 60 is important so that in use material carved away by the cutting edge end 64 is directed into the conduit. The structure of the cutting edge 60 and generally of the cutting portion 18 is such that when material is cut away by the cutting edge end 64 it is directed into the conduit 16 for removal and is not allowed the possibility of contacing the surrounding gel covering or anything else. The cutting edge 60 is preferably constructed in a plane which is perpendicular to the elongated axis of the pickup conduits 16.

The shaped end portion 58 having the cutting surface 62 facilitates directing the apparatus 10 in an essentially linear path over a gel surface covering 72 and has an areal opening at its end which is smaller than the internal areal opening of the elongated shank 54 of the pickup conduit 16 to provide a greater suction force at the opening of the shaped end portion 58 for easy removal of the gel as the gel cutting apparatus 10 traverses a generally linear path over the gel surface 72.

Figure 6:
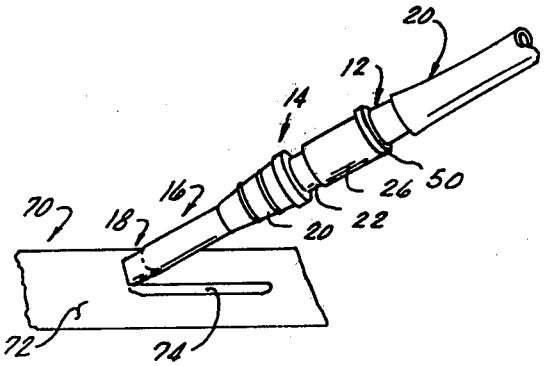
FIG. 6 is a perspective view of the gel cutting device in use cutting a notch in the gel covering of a slide.

FIG. 6 shows the gel cutting device 10 positioned as it is when in use and operation. As shown, the gel cutting device 10 has the flexible conduit 20 attached to the outlet body portion 12 and the cutter portion 18 in contact with a gel coated slide clearly indicated at 70. The slide 70 consists of an imperforate gel supporting member, such as a strip of celluloid or the like having the covering 72 of gel material such as agar gel on one side thereof. The cutting device 10 is used by placing the end portion 58 on gel surface 72 and subsequently moving it to cut a slot 74 in the covering 72 thereto the gel supporting surface. Slot 74 is generally a linear path. As shown on page 6 the cutting device 10 is turned so one corner of the cutting edge end 64 contacts the gel covering 72 and cuts same in a narrow slot. Preferably a water vacuum suction device is connected with the flexible conduit 20, this is practice has been found to provide a sufficient suction to remove gel material pulling same through the pickup conduit 16 into the body of the device. Once the gel material has been carved away by the cutting edge 60, it is moved by the suction pressure through the conduit 16 and into the cavity of the hollow body. In the event that only a small amount of the gel material is carved away and pulled into the body cavity it will remain in this cavity and can be removed therefrom upon separation of the body portions 12 and 14 at a later time. In the event that a great quantity of gel material is carved away it may be drawn into the conduit 20 and passed to the vacuum pump apparatus whereupon it may be removed from the filter of the device. In practice it has been found the gel cutter 10 with the oval shaped cutting edge 60 can be used to cut narrow (and preferably linear) slots when the narrow portion is turned so the rounded ends of the cutting edge 60 can be used for carving purposes. Also it has been found the cutting portion 18 can be turned so the wider portion of the cutting portion 18 is used for carving, this produces a wide slot.

Further in the use and operation of the gel cutter 10 of this invention, it is to be noted that the structure can be easily separated into two major components; one component consisting of the outlet body portion 12 and the other consisting of the inlet body portion 14 and attached pickup conduit 16. The device is constructed so as to be easily separable so that it may be taken apart andd cleaned as necessary. The gel cutting device 10 is preferably cleaned shortly after it use to prevent the hardening of the gel material within the device which would eventually plug the passageways. Preferably the outlet body portion 12 and the inlet body portion 14 are constructed to a plastic-like material and produced by molding or separate one-piece structures. The end portions of the inlet and outlet body portions, 14 and 12, are sized so the exterior of the pickup conduit 16 will pass thereinto and be retained in same and interference fit in the small end of either piece. Normally, the pickup conduit 16 will be inserted in the passageway 29 of the inlet body portion 14 and retained therein for use and cleaning. In the event the pickup conduit 16 becomes loose and its fit in the inlet body portion passageway 29 becomes such that a sufficient suction cannot be maintained or the conduit will not retain its fixed position, at such time the conduit 16 can be removed and inserted in the passageway 39 in the outlet body portion 12 and the flexible conduit 20 can be attached over the inlet portion 29 of the inlet body portion 14. Switching of the pickup conduit 16 from the inlet body portion 14 to the outlet body portion 12 does not substantially change the scope of or operation of the invention because the appropriate end portions of the body portions are constructed similarly for this purpose. In the normal use of the gel cutter 10, it is grasped about the body portion by a persons hands with the handles 36 and 50 held by the fingers so it can be maneuvered into positioned as desired.

In the manufacture of the gel cutting device structure of this invention, it is obvious that the device can be used with a vacuum source to carve trenches, slots, etc., in gel material which is the function of the device. It is obvious that the structure of the gel cutting device can be in part easily molded by using injecting molding techniques or other plastic part forming methods. The pickup conduit 16 can be easily constructed from an elongated segment of a tube and have the cutter portion 18 pressed, flattened or formed thereinto along with the cutting edge 60 on the end portion of the tube. Care must be taken to form the cutting surface 62 and the position shown in FIG. 5 wherein it slopes into the interior of the conduit. In assembling and using the cutting device, the conduit 16 can be inserted in the passageway 31 of the inlet body portion 14 and if necessary can be placed in the passageway 39 of the outlet body portion 12 whereupon the flexible conduit is reversed also in its position.

In the use and operation of the gel cutting structure of this invention, it is seen that same provides a device for simply and easily carving trenches, slots, wells, etc., in gel material and removing the cut material from the area in which it is cut. The gel cutting device is operable to cut a linear slot in a layer of agar gel material on a gel coated slide and can be turned into making the slot narrow or wide depending upon the users choice. When in use, gel material cut away by the cutting edge is directed into the pickup conduit portion of the device and moves into the hollow body portion of the device by means of vacuum suction pressure whereupon it can collect for removal at a later time. The gel cutter is designed to be a vast improvement over the cutter in U.S. Pat. No. 2,463,455, by M. Dann, because of a narrowing of the respective diameters of the body portions 12 and 14, of pickup conduit 16, and of the end portion 58. The converging diameters yield a greater suction at the end 58 as the device 10 is pushed in a generally linear path. The body portion of the gel cutter is separable into two portions so as to provide for easy cleaning and removal of the cutaway gel material. In actual use of the gel cutting device of this invention it has been found that only a gentle suction action is necessary to remove agar gel from a coated slide and that precise trenches and wells can be formed in a slide by using a straight edge or guide along with the gel cutter.

As will become apparent from the foregoing description of the applicants gel cutting structure, relatively simple and inexpensive means have been provided to form trenches and wells in gel coated slides and remove gel from the cutting area of the tool by suction force. The gel cutter structure is simple in its overall structure, economical to manufacture and simple to use. The gel cutter structure is usable with a vacuum suction apparatus and disassembleable for cleaning and may be used again and again. The structure itself can be produced economically since it can be formed easily by conventional and common molding and manufacturing techniques.

I claim:

1. A gel cutting apparatus comprising a hollow substantially cylindrical body having an inlet and an outlet to provide fluid communication therethrough, a cutter portion attached to said inlet, a vacuum pressure source connected to said outlet, said cutter portion including a structure defining an essentially elongated conduit having a flattened end and having an edge portion defining a substantially elliptical structure sharpened on its periphery, said elongated conduit including an internal diameter smaller than the internal diameter of said hollow body to provide greater suction force in said elongated cutter portion, said flattened end facilitates directing said apparatus in an essentially linear path over a gel surface and includes an areal opening smaller than the internal areal opening of said elongated conduit of said cutter portion to provide a greater suction force at said opening of said flattened end for easy removal of said gel and said gel cutting apparatus traverses a generally linear path over said gel surface, said cutter portion is essentially longer than said hollow body, said hollow body comprises a first conduit section having a second outlet end and said inlet and a second conduit section including a second inlet end and said outlet, said second outlet end removably lodges within said second inlet end, said inlet and said outlet generally comprise approximately identical diameters such that said inlet may be attached to said vacuum pressure source and said outlet may be connected to said cutter portion.

2. The gel cutting apparatus of claim 1 wherein said hollow body additionally includes thereon a means providing a handle thereon for pushing said flattened end in a linear path over said gel surface.

3. The gel cutting apparatus of claim 2 wherein said second outlet end and said second inlet end are essentially cylindrically shaped.

4. The gel cutting apparatus of claim 3 wherein said means providing a handle comprises a plurality of circular flanges circumferentially attached to said first conduit section and said second conduit section.

* * * * *

UNITED STATES PATENT OFFICE

CERTIFICATE OF CORRECTION

PATENT NO. : 3,949,471

DATED : April 13, 1976

INVENTOR(S) : Leo P. Cawley

It is certified that error appears in the above-identified patent and that said Letters Patent are hereby corrected as shown below:

Column 2, line 2, delete "to" (third occurrence) and insert therefor ---for---

Column 3, line 12, delete "invenion" and insert therefor ---invention---;

line 49, delete "pluality" and insert therefor ---plurality---.

Column 4, line 28, delete "outer" and insert therefor ---outlet---;

line 57, delete "with" and insert therefor ---which---.

Column 5, line 1, delete "anngular" and insert therefor ---angular---;

line 8, delete "contacing" and insert therefor ---contacting---;

line 37, delete "is" and insert therefor ---in---;

line 67, delete "andd" and insert therefor ---and---;

line 68, delete "it" and insert therefor ---its---.

Column 6, line 4, delete "to" and insert therefor ---of---;

line 14, delete "29" and insert therefor ---20---;

line 28, delete "positioned" and insert therefor ---position---.

UNITED STATES PATENT OFFICE

CERTIFICATE OF CORRECTION

PATENT NO. : 3,949,471

DATED : April 13, 1976

INVENTOR(S) : Leo P. Cawley

It is certified that error appears in the above-identified patent and that said Letters Patent are hereby corrected as shown below:

Column 7, after line 20, insert the following paragraph ---While the invention has been described in conjunction with preferred specific embodiments thereof, it will be understood that this description is intended to illustrate and not limit the scope of the invention, which is defined by the following claims.---.

Claim 1, Column 8, line 8, delete "and" and insert therefor ---as---.

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*